US006318559B2

(12) United States Patent
Cordonnier et al.

(10) Patent No.: US 6,318,559 B2
(45) Date of Patent: Nov. 20, 2001

(54) AIR CLASSIFIER WITH ROTOR COMPRISING TWO INDEPENDENTLY CONTROLLABLE PARALLEL FLOW PATHS

(75) Inventors: Alain Cordonnier, Lille; Danielle Lemaire, Villeneuve d'Ascq, both of (FR)

(73) Assignee: FCB Societe Anonyme, Montreuil (FR)

( * ) Notice: Subject to any disclaimer, the term of this patent is extended or adjusted under 35 U.S.C. 154(b) by 0 days.

(21) Appl. No.: 09/835,150

(22) Filed: Apr. 16, 2001

Related U.S. Application Data

(6262) Division of application No. 09/202,471, filed as application No. PCT/FR97/00678 on Apr. 15, 1998.

(51) Int. Cl.[7] ..... B07B 4/06
(52) U.S. Cl. ..... 209/154; 209/714
(58) Field of Search ..... 209/154, 714, 209/713, 138, 139.1

(56) References Cited

U.S. PATENT DOCUMENTS 2,988,220 * 6/1961 Gracza ..... 209/714
4,626,343 * 12/1986 Folsberg ..... 209/138
4,689,141 * 8/1987 Folsberg ..... 209/714
4,693,811 * 9/1987 Lohnherr ..... 209/139.2
4,756,428 * 7/1988 Jaeger ..... 209/135
4,792,393 * 12/1988 Blasczyk et al. ..... 209/135
4,818,376 * 4/1989 Tanaka et al. ..... 209/135
5,120,431 * 6/1992 Cordonnier ..... 209/135
5,533,629 * 7/1996 Ito et al. ..... 209/714
5,622,321 * 4/1997 Brundiek et al. ..... 241/79.1
5,624,039 * 4/1997 Folsberg ..... 209/714
5,957,300 * 9/1999 Nardi et al. ..... 209/143

* cited by examiner

*Primary Examiner*—Christopher P. Ellis
*Assistant Examiner*—Daniel K Schlak
(74) *Attorney, Agent, or Firm*—Harrison & Egbert

(57) ABSTRACT

A centrifugal type pneumatic separator having a rotor and a housing. The rotor has a plurality of vanes distributed around a periphery thereof. The housing contains the rotor. The housing has an air input conduit, a material input conduit and an evacuation conduit. The air input conduit passes air through channels formed between adjacent vanes such that air and material flows toward the evacuation conduit. The rotor is divided so as to define at least two separate passages whereby air from the air input conduit flows into the evacuation conduit as two separate and parallel streams.

1 Claim, 5 Drawing Sheets

FIG. 2
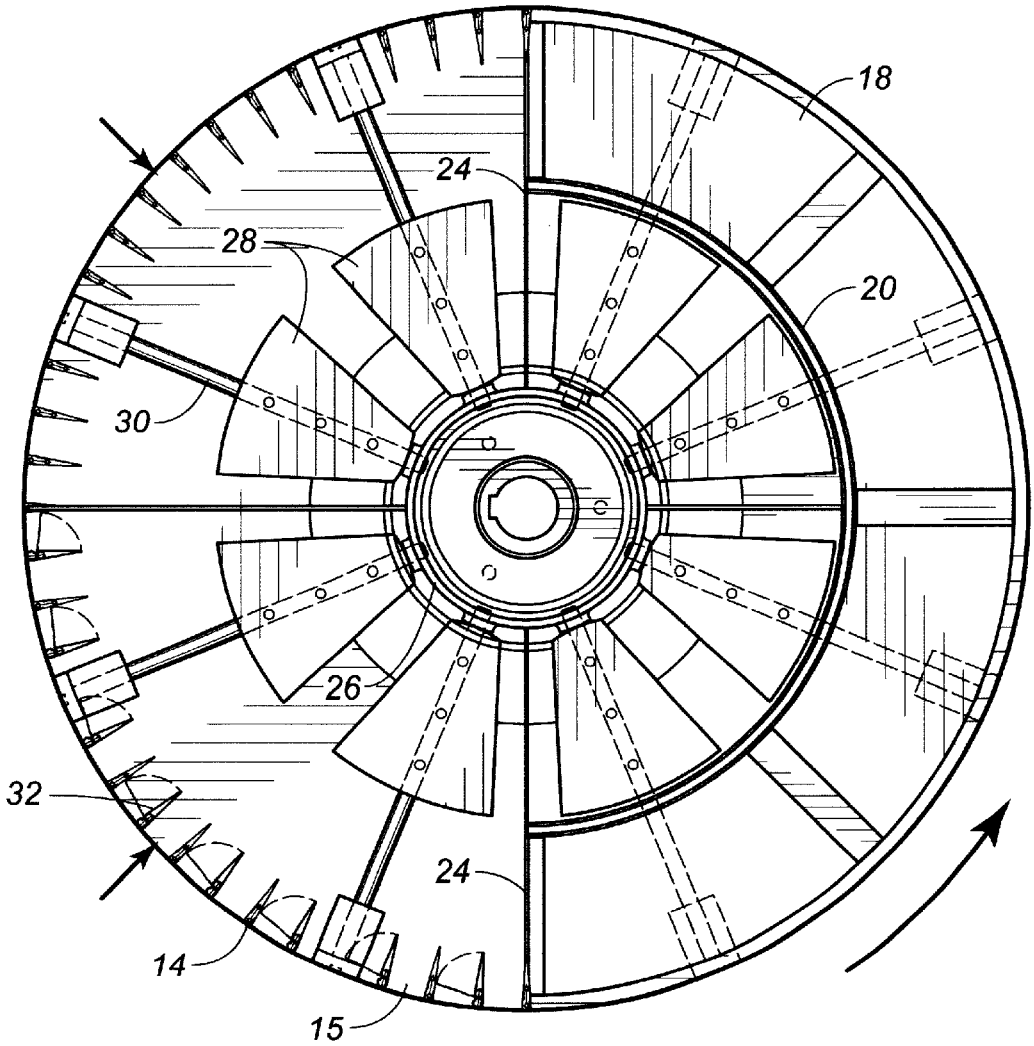
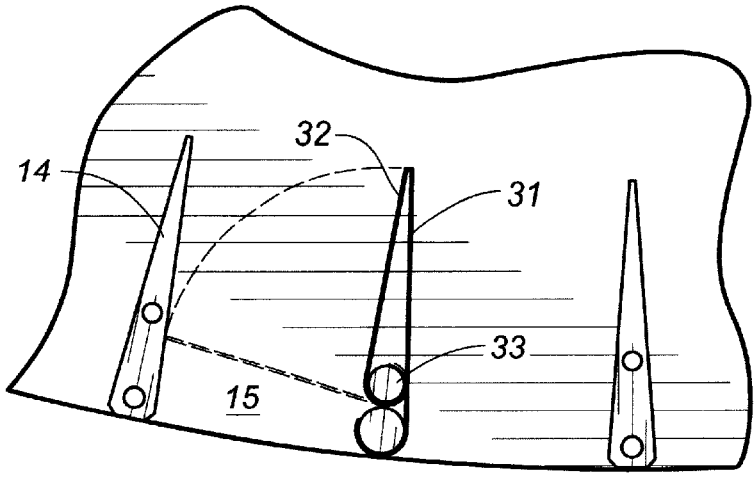
FIG. 3

AIR CLASSIFIER WITH ROTOR COMPRISING TWO INDEPENDENTLY CONTROLLABLE PARALLEL FLOW PATHS

This application is a divisional of copending applications (s) application Ser. No. 09/202,471 filed on Dec. 10,1998, which is a 371 of International Application PCT/FR97/00678 filed on Apr. 15, 1998 and which designated the U.S.

TECHNICAL FIELD

The present invention relates to a pneumatic separator having a centrifugal action designed to grade or classify a granular material into a fine fraction and a coarse fraction. The present invention is of the type including a rotor with a vertical axis provided with vanes regularly distributed over its periphery, guide blades disposed about the rotor, along the generating lines of a fictitious cylinder, and capable of imparting to a stream of air or another gas penetrating the fictitious cylinder a movement of rotation about the axis of the cylinder, and a housing in which are enclosed the rotor and the guide blades and which is equipped with one or more inputs for the air and for the material to be graded, with an output orifice disposed above or below the rotor and through which is sucked the stream of air laden with the fine fraction of the material, and with at least one output for the coarse fraction, with the air penetrating the rotor at its periphery, via the channels formed between the vanes, and circulating inside the rotor towards the output orifice.

BACKGROUND ART

In a separator of this type, the material to be graded and the air stream can introduced separately inside the space with an annular section defined by the guide blades and the rotor, or the material to be graded can be placed in suspension in the air stream before the latter is admitted into the space, through the blades. The air stream then penetrates the rotor and is evacuated via the output orifice.

In both cases, the air stream and the material to be graded are subjected to rotation, about the axis of the rotor, in the space with an annular section contained between the rotor and the guide blades. The particles forming the coarse section of the material are projected by the centrifugal force generated by this rotation against the guide blades and drop through the effect of gravity into a collecting hopper provided with an evacuation orifice, while the particles forming the fine fraction are entrained by the air stream through the rotor and the central output orifice.

The fine fraction that is separated contains practically all the particles the size of which is smaller than a first dimension, while the coarse fraction contains practically all the particles the size of which is larger than a second dimension, which is larger than the first one. In addition, the two fractions contain particles the size of which is between the first and second dimensions. This is reflected by a distribution curve comprising two substantially horizontal portions linked by an inclined portion the slope of which characterizes the separator.

The distribution of the particles of intermediate size in one or the other of the fractions characterizes the cut-off precision of the separator. In general, it is attempted to obtain, by construction, a cut-off that is as marked as possible between the two fractions, that is to say to reduce the interval between the first and second dimensions, which is reflected by a distribution curve with a steep slope.

In certain cases, the product that it is sought to be obtained has to have a grain size distribution that differs from that of the fraction, whether fine or coarse, obtained by means of a separator of this type. This applies particularly to cement obtained by compression grinding the clinker. Hitherto, the only solution to this problem was to use two separators placed in series or in parallel and adjusted to the different cut-off dimensions. This represents a costly solution.

The object of the present invention is to perfect separators of the type concerned so that it is possible to adjust the slope of the distribution curve in a simple manner, that is to say to modify the grain size distribution of the particles the size of which is between the first and second dimensions.

SUMMARY OF THE INVENTION

The separator according to the invention is characterized in that the air circulating through the rotor is divided into at least two separate streams, and the rotor is equipped with means for adjusting the speed and/or the flow rate of at least one of the streams.

If the speeds of the two air streams through the channels provided between the vanes of the rotor are adjusted to different values, the drag forces exerted by the two streams upon a particle of a given mass and given dimensions will differ. In the channels through which the air stream flows at a reduced speed, the balance between the drag forces and the centrifugal forces, which corresponds to the theoretical cut-off mesh, will occur for a smaller particle dimension than that for which the balance occurs in the other channels, through which the air speed is higher. Everything will thus take place as if there were two separators in parallel having different cut-off meshes. By adjusting the speeds of the air streams, the cut-off meshes can be adjusted and, consequently, the grain size distribution of the particles in the finished product.

The means for adjusting the speed and/or the flow rate of the air streams can be formed by means for varying the input section of at least some of the channels provided between the vanes of the rotor and/or by means for varying the passage sections of the openings through which the air streams escape from the rotor.

According to a particular form of embodiment, the rotor is divided into sectors by radially disposed vertical partitions, and each sector communicates with the air output orifice via an opening provided with means for adjusting the passage section which can be formed by pivoting flaps or diaphragms. In this form of embodiment, the radial partitions perform the anti-vortex function of the second set of vanes of the separator.

To vary the section of the channels formed between the vanes of the rotor, use can be made of the plates disposed in the channels, each plate being movable by rotation about an axis parallel to the axis of the rotor, between a first position, wherein it leaves practically all of the section of the respective channel free, and a second position, wherein it closes off the channel practically completely.

It can be chosen, for example, to place at the channel output two plates pivotally mounted on a vertical axis disposed in the median plane of the channel. These plates can be brought, via an appropriate mechanism, from a first position in which they are pressed against one another and disposed practically in the median plane, to a second position, in which their free ends abut the ends of the vanes defining the channel.

Alternatively, some vanes of the rotor can be orientatable about vertical axes so that their ends can come to bear against a neighbouring vane to close off the channel that they define.

Another solution is to produce the vanes in two portions; a fixed part and mobile portion, orientatable by rotation about a vertical axis. For example, one of the faces of the vane can be fixed, and the other mobile and capable of pivoting about a vertical axis located close to the periphery of the rotor so as to come to bear on the adjacent vane to close off the channel that they form. According to another form of embodiment, the radially external portion of the vane can be fixed, and its internal portion rotary. The mobile portions of two adjacent vanes is able to be brought into abutment with one another to close the channel defined by the two vanes.

Further characteristics of the object of the invention will emerge from a study of the following description, which refers to the accompanying drawings, which show, by way of a non-limitative example, several forms of embodiment of the invention.

BRIEF DESCRIPTION OF THE DRAWINGS

FIG. 2 is a top view of the rotor of FIG. 1, with the ring partially closing the rotor at its upper portion removed over half of the rotor;

FIG. 3 is a larger scale view of a detail of the rotor;

DETAILED DESCRIPTION OF THE INVENTION

Figure 1:
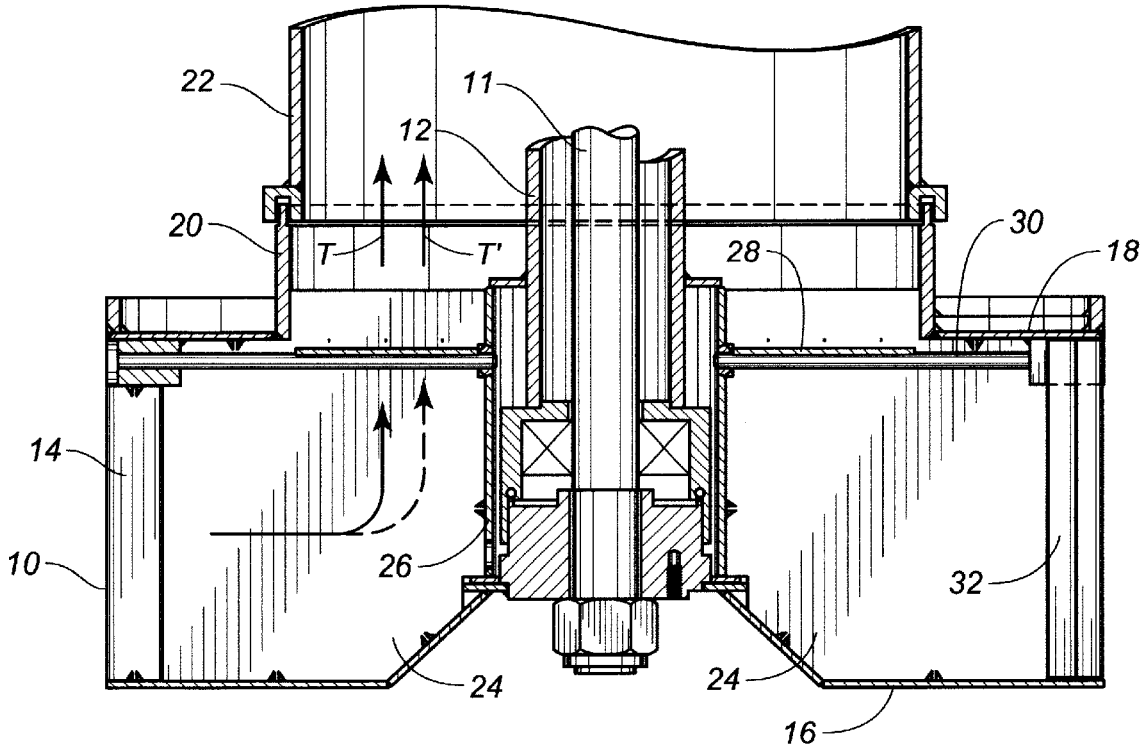
FIG. 1 is a diametrical sectional view of a separator rotor according to the invention

The separator according to the invention is of the type disclosed in French patent No. 90.01673, to which reference can be made for further details. As described above, it comprises a rotor with a vertical axis, guide blades disposed about the rotor and a housing within which are enclosed the rotor and the guide blades, and which is provided with one or more inputs for the product to be graded and for the air stream, one or more outputs for the coarse fraction and a central output orifice for the air stream laden with the fine fraction of the product.

The rotor 10 is fixed to the lower end of a vertical shaft 11 mounted, via roller bearings, in a tubular support 12 fixed to the roof of the separator housing. The shaft is coupled to a variable speed control unit enabling the rotor to be rotated at the desired speed.

The rotor comprises a large number of vertical vanes 14 regularly spaced over its periphery, and the lower and upper ends of which are fixed, respectively, to an end portion 16 and to a ring 18. A cylindrical shell 20, fixed to the internal edge of the ring 18, defines an output passage for the air laden with particles of small dimensions that have penetrated the rotor via the channels 15 provided between the vanes 14. This shell is connected, via a rotating joint, to the lower end of an evacuation conduit 22 passing through the roof of the separator housing.

The interior of the rotor is divided into four equal sectors by four radially disposed vertical partitions 24. These partitions are fixed to the end portion 16, to ring 18 and to a shell 26 surrounding the lower portion of tubular support 12, and itself fixed to end portion 16.

The output opening defined by ring 18 and shell 26 is partially closed off by pivoting flaps 28 (two per sector in the form of embodiment shown). Each flap is fixed to a shaft 30 mounted on bearings fixed to ring 18 and shell 26. A square element provided on the outer end of each shaft 30 enables the orientation of the flaps to be adjusted and, consequently, the section of the output opening of the respective sectors, and a locking system enables the flaps to be maintained in the desired position, after adjustment.

In the sector of the rotor represented on the lower left-hand portion of FIG. 2, every other vane 14 is formed by a fixed portion constituting the active face and a mobile portion 32 orientatable about a vertical axis located close to the leading edge of the vane (see FIG. 3). This portion 32 is displaceable, between a first position (shown by a solid line in FIG. 3) where it is pressed against the fixed 31 of the vane, in such a way as to leave the input of canal 15 free, and a second position (shown in dot and dash lines) where it completely closes of this input. The orientation of the mobile portions of the vanes can be controlled individually or in groups. These two-part vanes must be distributed over the periphery of the rotor in such a way that the latter is balanced. For example, two diametrically opposed sectors of the rotor could be equipped therewith.

Figure 4:
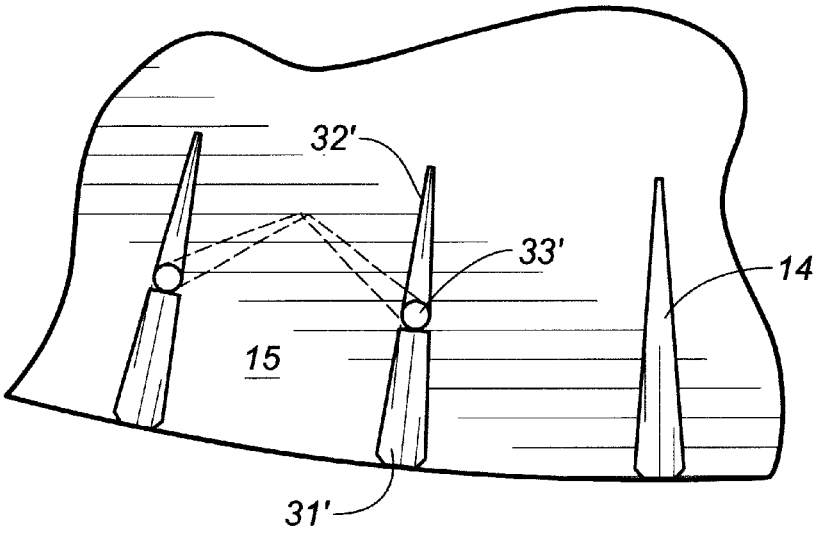
FIGS. 4 and 5 are views analogous to that of FIG. 3, illustrating alternative forms of embodiment.

FIG. 4 shows another form of embodiment of the means for closing off certain channels 15 of the rotor. According to this alternative embodiment, the two vanes defining a channel are in two portions: an external portion 31' which is rigidly fixed to the structure of the rotor, and an inner portion 32', which is capable of pivoting about a vertical axis 33'. A control mechanism, not shown, enables the mobile portion 32' of each vane to be displaced between two positions: a first position, shown in solid lines in FIG. 4, wherein the portions 31' and 32' are in extension of one another and channel 15 is completely clear, and a second position, shown in dot and dash lines, wherein the free ends of portions 32' of the two vanes are in abutment with one another, and channel 15 is closed off.

Figure 5:
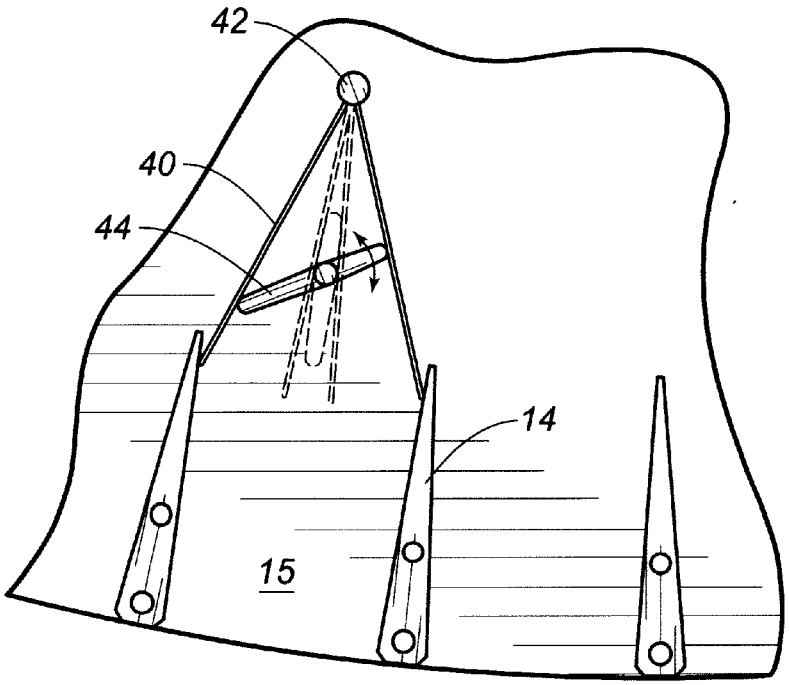

In the alternative embodiment of FIG. 5, the channel closing means are formed by pairs of vertical plates 40 placed inside the rotor, the two plates of a pair hinged by their internal edges on the same vertical axis 42 disposed in the median plane of the channel. A cam 44 placed between the two plates, and controlled by an appropriate mechanism enables the two plates to be moved apart to bring their free ends in abutment against vanes 14 and to close off the output of channel 15, as shown in solid lines in the figure. When the cam is rotated to bring it into the median plane of the channel, plates 40 are pressed against the cam by centrifugal force, as shown in dot and dash lines in the figure, and the output of channel 15 is almost completely clear.

According to an alternative embodiment, not shown, some vanes 14 could be orientatable by being mounted in such a way as to be able to pivot on the rotor about vertical axes located close to their leading edges and to come into abutment against the fixed or orientatable neighboring vanes to close of the corresponding channels 15.

When in service, the separator is incorporated in a circuit, open or closed, through which flows a stream of gas, for example an air stream. On penetrating the rotor, the air stream divides into as many elementary streams as there are channels 15 between the vanes 14. At the output from the channels, these elementary streams group together in each sector of the rotor into four secondary streams which escape through the output opening defined by ring 18 and shell 26. If all the flaps 28 are in the vertical position and if all channels 15 are open, the flow rates of the four secondary streams are equal and the speeds of the elementary streams are equal; the operation of the separator is the same as that of a conventional separator.

If one part of channels 15 is closed off in one of the sectors of the rotor and, simultaneously, flaps 28 are partially closed in the other sectors, so that the air stream divides into two different streams such that the flow rate passing through each of the sectors of which flaps 28 are closed is less than the flow rate passing through the sector the flaps of which are open, the speed of the air through channels 15 that have remained open in the first sector will be, for these two reasons, higher than in the channels in the other sectors. Since the drag forces that are exerted on the particles and oppose the centrifugal force in channels 15 depend on the speed of the air, while the centrifugal forces depend only on the speed of rotation of the rotor, the dimension of the particles for which the centrifugal and drag forces are balanced (theoretical cut-off mesh) will be greater in the first sector than in the others. Everything takes place as if there were two separators in parallel working with different cut-off meshes and the fine fractions of which were mixed at the output from the separator. By adjusting the air input section in one or more sectors of the rotor and by adjusting the flow rates of air circulating in the different sectors, it is possible to select two different cut-off meshes, or more, thus enabling the desired grain size distribution to be obtained in a given range.

Figure 7:
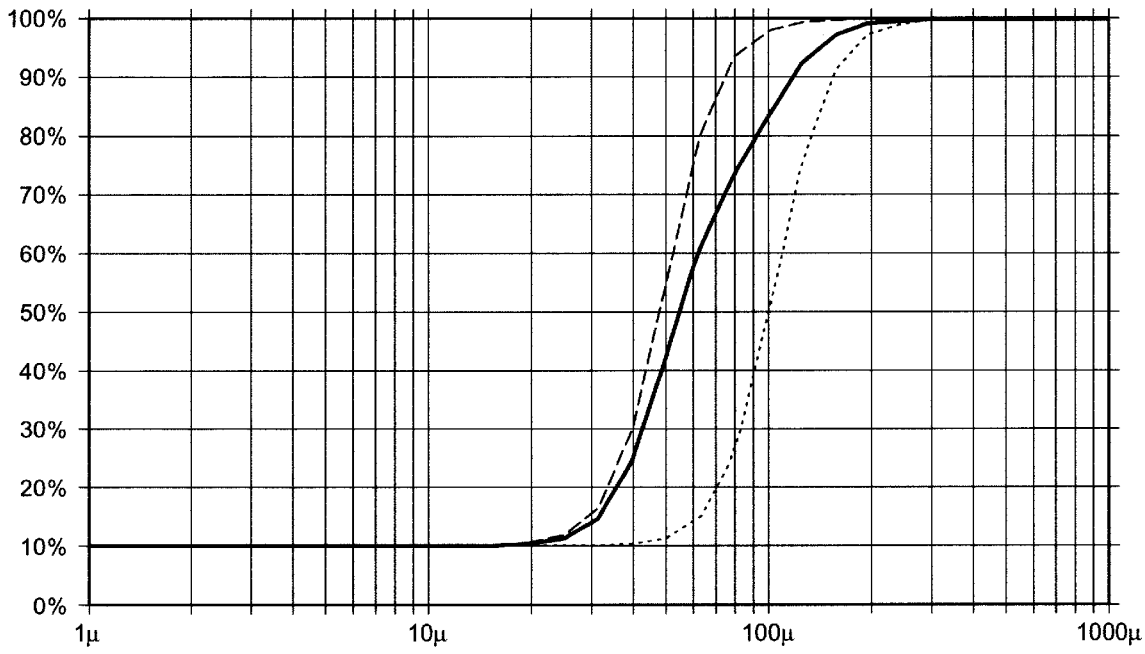
FIG. 7 shows the distribution curves of a conventional separator and of the separator according to the invention.

FIG. 7 shows, by way of example, the distribution curves of a conventional separator for two cut-off meshes, and of a separator according to the invention. The distribution curve gives the weight proportion, expressed in %, of the particles of a given size in the coarse fraction; an inverse curve would be obtained for the fine fraction. For the dimensions of particles smaller than 20 $\mu$m and greater than 200 $\mu$m, the three curves merge. In the 20–200 $\mu$m range, the dashed curve corresponds to a conventional separator the theoretical cut-off mesh of which is 50 $\mu$m, the dotted curve corresponds to a conventional separator the theoretical cut-off mesh of which is 105 $\mu$m. The solid line curve was obtained with the separator according to the invention; it can be seen that its slope is less steep than that of the conventional separators, which means that, in the 20–200 $\mu$m range, the grain sizes have a greater spread.

The invention thus makes it possible to have a distribution curve with an adjustable slope and, consequently, to obtain a finished product having the desired grain size distribution in a given grain size range by acting both on the speed of the rotor and on the orientation of the vanes, on one hand, and on the positions of the flaps 28 and on the settings of the channel 15 sections, on the other hand.

Figure 6:
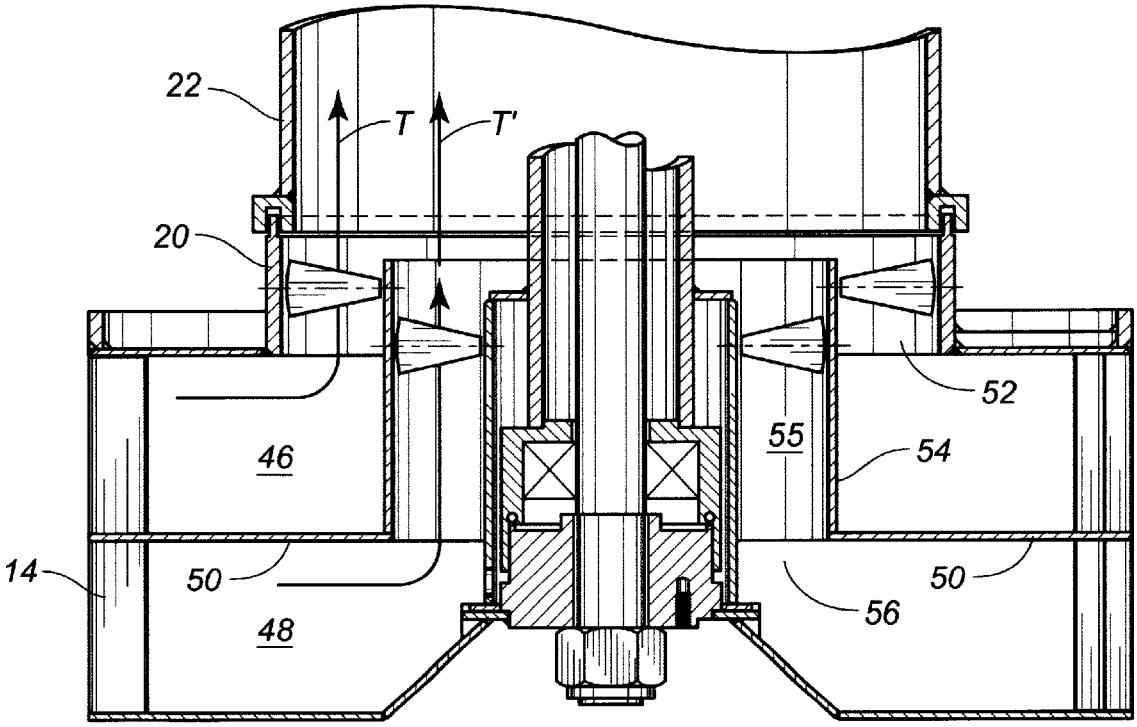
FIG. 6 is a diametrical sectional view of another separator rotor according to the invention.

Instead of being divided into sectors by radial partitions, the rotor could be designed as shown in FIG. 6 and divided into two portions 46, 48, by a horizontal partition 50 located, for example, at mid-height, an opening 52 provided in the upper wall of the rotor causing the upper portion of the rotor to communicate with air evacuation conduit 22 of the separator, and a shell 54, the diameter of which is less than that of the opening 52, being connected to a central opening 56 in the partition and defining a passage 55 placing the lower portion of the rotor in communication with evacuation conduit 22 via the first opening. The rotor is provided with means such as those illustrated by FIGS. 3, 4 and 5 for closing off some of the channels provided between its vanes, over at least a part of their height, and with means such as flaps 28 for adjusting at least one of the output openings. According to the same principle, the rotor could be divided into more than two superposed portions. It would even be possible to do away with the horizontal partition or partitions, with the division of the air into two or more streams in the rotor resulting from the arrangement of one or more plunger tubes placed in the axis of the rotor.

Means other than pivoting flaps, for example diaphragms, could be used to adjust the sections of the output openings of the rotor. It goes with saying that these modifications and all those that can be made to the forms of embodiment described, through the use of equivalent technical means, are included within the scope of the invention.

What is claimed is:

1. A centrifugal type pneumatic separator comprising:

a rotor having a vertical axis, said rotor having a plurality of vanes distributed around a periphery thereof;

a housing containing said rotor, said housing having an air input means and a material input means, said material input means for passing material into said rotor, said housing having an evacuation conduit means for passing air laden with a fine fraction of material, said housing having an outlet means for passing a coarse fraction of material from said rotor, said air input means for passing air to a periphery of said rotor through channels formed between adjacent vanes of said plurality of vanes such that the air flows within said rotor toward said evacuation conduit means, said rotor being divided to define at least two separate passages whereby air from said air input means flows into said evacuation conduit means as at least two separate streams in parallel relation; and adjustment means connected to said rotor for adjusting a flow rate of at least one of said separate streams.

* * * * *